United States Patent [19]

Nielsen

[11] Patent Number: 4,554,911

[45] Date of Patent: Nov. 26, 1985

[54] MASSAGING TOOL AND METHOD FOR LOWER-EYELIDS AND ZYGOMATIC SKIN

[76] Inventor: Margaret J. Nielsen, 2918 S. 121st St., Omaha, Nebr. 68144

[21] Appl. No.: 541,457

[22] Filed: Oct. 13, 1983

[51] Int. Cl.[4] ..... A61H 15/00; A45D 40/26

[52] U.S. Cl. ..... 128/57; 132/88.7; 132/1 R

[58] Field of Search ..... 132/1 R, 88.5, 88.7; 128/57, 60, 61, 62 R, 62 A, 67

[56] References Cited

U.S. PATENT DOCUMENTS

| | | | |
|---|---|---|---|
| 731,693 | 6/1903 | Lennox | 128/57 |
| 781,555 | 1/1905 | Schanz | 128/57 |
| 1,635,744 | 7/1927 | Duncan | 128/57 |
| 1,872,832 | 8/1932 | Silverberg | 128/57 |
| 2,168,842 | 8/1939 | Kesteven et al. | 128/61 |
| 2,193,249 | 3/1940 | Flanders et al. | 128/57 |
| 2,246,263 | 6/1941 | Patterson | 128/57 |
| 2,748,763 | 6/1956 | Kosloff | 128/57 |
| 3,081,769 | 3/1963 | Ackerman | 128/67 |
| 3,884,232 | 5/1975 | Braun | 132/88.7 |
| 3,980,079 | 9/1976 | Brodbeck | 128/57 |

*Primary Examiner*—Gene Mancene
*Assistant Examiner*—Carolyn A. Harrison
*Attorney, Agent, or Firm*—George R. Nimmer

[57] ABSTRACT

Disclosed are massaging tools and method for reducing accumulated subcutanaceous fat of the lower-eyelids and adjacent zygomatic skin areas. The skin massaging tool has at least one consecutive plurality of individually rotatable members for rollably traversing across the lower-eyelids and zygomatic skin areas and a manually wieldable handle portion for causing reciprocating rolling of the tool along the skin areas. A generally concave array of rotatable members ensures complete massaging of the lower-eyelids as the tool is reciprocated upwardly theretoward from the zygomatic area. The tool has the further capability to reciprocatably rollably traverse in the right-left directions along the same skin areas.

2 Claims, 9 Drawing Figures

MASSAGING TOOL AND METHOD FOR LOWER-EYELIDS AND ZYGOMATIC SKIN

BACKGROUND OF THE INVENTION

The FIG. 1 anatomical representation of a human frontal face alludes to the purpose of the present invention. "UL" and "LL" indicate the upper-eyelid and lower-eyelid skin, respectively, the left-right directional width of said eyelids being substantially "C". The dotted areas "Z" indicate the zygomatic skin areas connected to the lower-eyelids "LL", the latter having a concave upper extremity when they are in open condition. During the normal human aging process, subcutanaceous fat progressively accumulates beneath skin areas "LL" and "Z". For some persons, the progressive fat accumulates to such extent that such persons are subjected to physical discomfort and/or to unaesthetic excessive puffiness of the skin areas.

GENERAL OBJECTIVE OF THE INVENTION

It is the general objective of the present invention to provide a self-help physical therapy method utilizable by persons afflicted with excessive subcutanaceous fat accumulations at the lower-eyelids and adjacent zygomatic skin areas. It is an ancillary general objective to provide apt massaging tool for utilization by persons afflicted with such excessively accumulated subcutanaceous fattty deposits, whereby such uncomfortable and unaesthetic fatty deposits become of a physical consistency that is more amenable to removal by the human body's natural waste elimination processes.

GENERAL STATEMENT OF THE INVENTION

With the above and other objects and advantages in view, which will become more apparent as this description proceeds, the novel method and ancillary massaging tool might be generally summarized as follows. The method for physically treating the subcutanaceous fat of the lower-eyelids and zygomatic skin areas requires placing rollable members in contact with said skin areas epidermis and reciprocatably rollably traversing in the left-right and in the up-down directions so as to universally directionally massage the entire said skin area. The massaging tool comprises a frame member including a manually wieldable handle portion and mounting means adapted to revolvably support a consecutive plurality array of individually rotatable members, a certain plurality of the rotatable members being in a concave array so as to ensure coextensive coverage for the lower-eyelids as the tool is reciprocated in the up-down direction, and the tool also having the capability for reciprocatably rollably traversing the skin areas in the left-right directions.

BRIEF DESCRIPTION OF THE DRAWINGS

In the drawing, wherein like characters refer to like parts in the several views, and in which.

DETAILED DESCRIPTION OFV THE DRAWINGS

Figure 1:
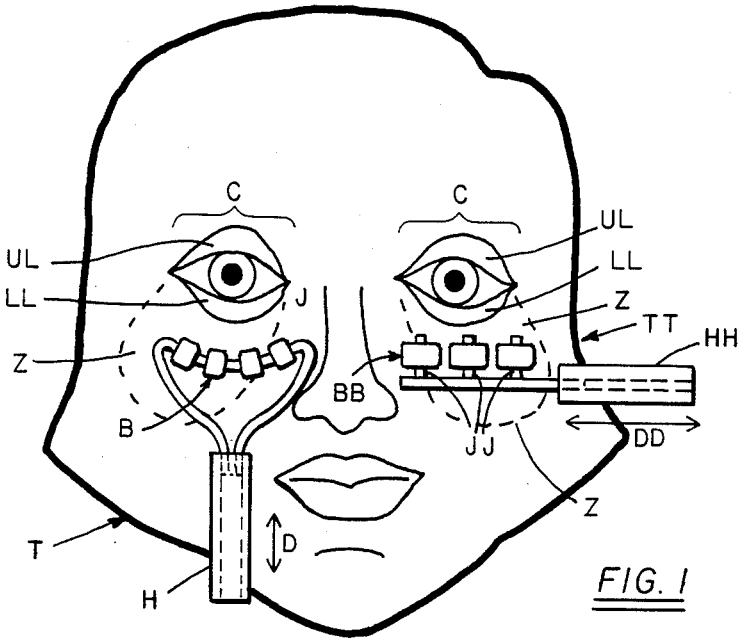
FIG. 1 is an anatomical schematic representation of a human frontal face and also alludes to the novel method of the present invention, such as utilizing two separately wieldable rudimentary implements, and similarly shown in frontal elevation.

In FIG. 1, two separate implements "T" and "TT" are employed to practice the novel method of the present invention, i.e. for physically treating subcutanaceous fat of the lower-eyelids "LL" and adjacent zygomatic skin area "Z". Implement "T" comprises a bent rod "J" (including a concave part) having the rod terminii secured within the bore of a rearwardly positioned tubular handle "H". A plurality of rollable members (e.g. tubular beads "B") are arrayed along and revolvably supported by the concave portion of rod "J", said concave beads array having a left-right directional width of substantially "C". Thus, as the user of implement "T" manually reciprocates handle "H" in the up-down directions "D", beads rollably traverse along epidermis skin areas "LL" and "Z" in directions "D", whereby said individually rotatable beads "B" physically massage and treat the subcutanaceous fat. The other implement "TT" comprises parallel axles "JJ" carried by a rod frictionally secured within the bore of tubular handle "HH". Each of the axles "JJ" revolvably supports a rollable member (e.g. tubular beads "BB"). Thus, as the user of implement "TT" manually reciprocates handle "HH" in the right-left directions "DD", beads "BB" rollably traverse the same epidermis areas "LL" and "Z", but in directions "DD", thereby physically massaging and treating the subcutanaceous fat from a different direction.

The massaging tool concept of the present invention generally comprises a frame member (e.g. "F1", "F2", "F3") including a manually wieldable handle portion (e.g. 10, 110, 210) and mounting means for revolvably supporting a consecutive plurality of individually rotatable members (e.g. "B", "BB", "BA", "BBA", "BBR"). The mounting means includes at least a non-linear and preferably concave elongate primary mounting means (e.g. 20, 120, 220), and sometimes also a secondary mounting means (e.g. 30, 130) for up-down and left-right rollable traversal, respectively, along the epidermis areas "LL" and "Z".

Figure 2:
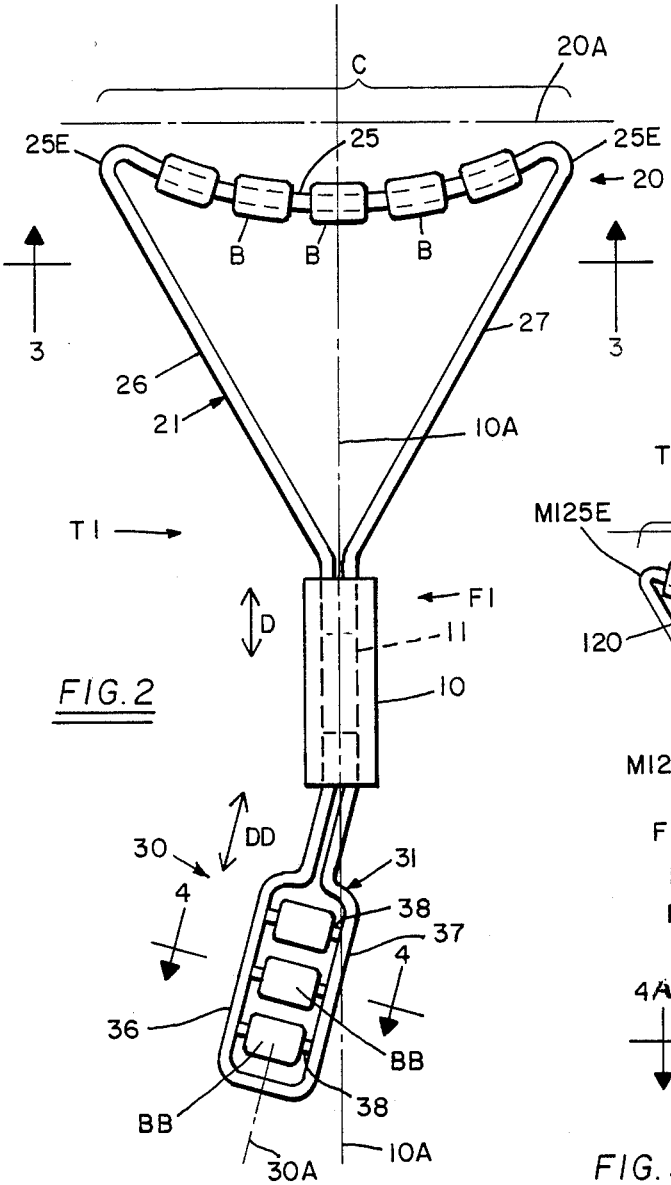
FIG. 2 is a frontal elevational view of an embodiment "T1" of the massaging tool concept of the present invention.
Figure 4:
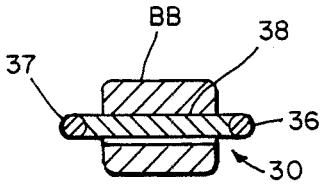
FIG. 4 is a sectional elevational view taken along line 4—4 of FIG. 2.
Figure 3:
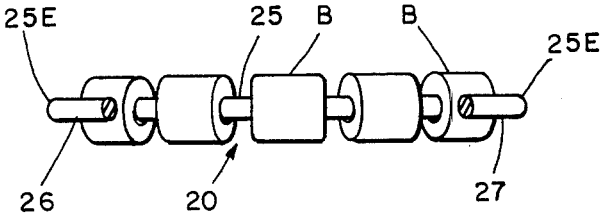
FIG. 3 is a sectional elevational view taken along line 3—3 of FIG. 2.

Frame member "F1" for the massaging tool embodiment "T1" of FIGS. 2-4 comprises a tubular handle portion 10 (having bore 11) and surrounding upright longitudinal-axis 10A. Primary mounting means 20 is located relatively forwardly of handle portion 10 and is positioned relative to a primary-axis 20A that abruptly intersects longitudinal-axis 10A, axes 10A and 20A being preferably substantially perpendicular. Primary mounting means 20 comprises a non-lineal elongate shaft 25 having first-end and second-end terminii 25E at a spacing of substantially "C"; the non-linearity of shaft 25 is preferably rearwardly concave with respect to primary-axis 20A or at least converges toward handle 10. Herein, a bent rod 21 provides a concave length 25, a left-wing 26, and a right-wing 27, the wings 26 and 27 rearwardly converging from ends 25E and being ultimately frictionally secured within tubular handle 10.

There is a secondary mounting means 30 located rearwardly of handle portion 10 and extends along a secondary-axis 30A that for style "T1" obliquely intersects longitudinal-axis 10A. Secondary mounting means 30 comprises a rod 31 bent into a pair of parallel legs including a first-leg 36 and a second-leg 37 spaced on opposite sides of secondary-axis 30A, said leg portions 36 and 37 being frictionally secured into handle 10 remote of wings 26 and 27. A plurality of parallel short-axles intervene between and connect legs 36 and 37 e.g. such as the three short-axles 38 shown.

Completion of massaging tool embodiment "T1" necessitates revolvably supporting a plurality of individually rollable members along primary mounting means 20 and along secondary mounting means 30. For example a consecutive plurality of five said beads "B" revolvably surround and are individually rollable about concave shaft 25, and each of the short-axles 38 revolvably supports a single tubular bead "BB".

Figure 4A:
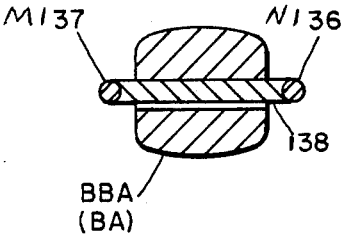
FIG. 4A is a sectional elevational view similar to that of FIG. 4 and showing an an alternately shaped rollable member.

Though the cylindrically tubular beads "B" and "BB" are adequate for the massaging purposes of the present invention, the barrel-shaped (i.e. having convex rolling surfaces) beads "BA" and "BBA" depicted in FIG. 4A seem to provide a more stimulating and efficaceous massaging action for skin areas "LL" and "Z".

Figure 5:
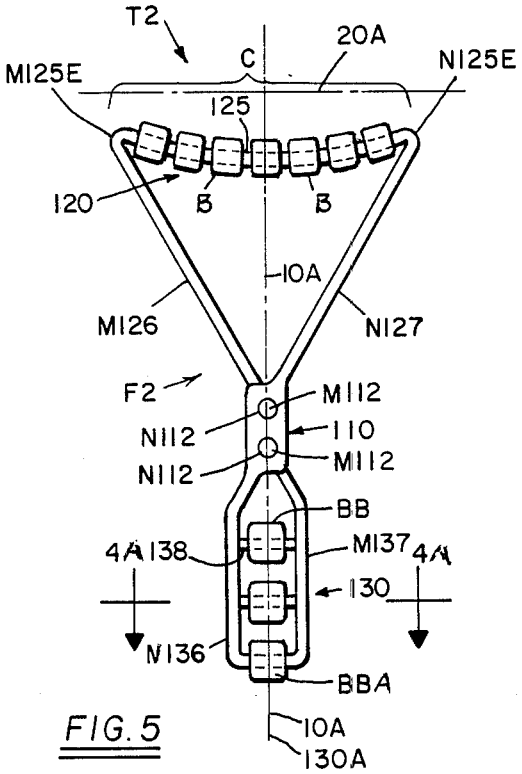
FIG. 5 is a frontal elevational view of an embodiment "T2" of the massaging tool.

Massaging tool embodiment "T2" seen in FIG. 5 has a frame member "F2" similar in many respects to the frame member "F1" of embodiment "T1". In both frame members, handle portions (10, 110) intervene between and connect a primary mounting means (20, 120) to a secondary mounting means (30, 130). Primary mounting means 120 includes a concave shaft 125 analagous to concave shaft 25 and for similarly revolvably supporting beads ("B", "BA"), shaft terminii M125E and N125E of said spacing "C" parallel primary-axis 20A, rearwardly convergent left-wing M126 and right-wing N127 akin to wings 26 and 27, and a sectional configuration 3A—3A very similar to that seen in FIG. 3. Secondary mounting means 130 has a first-leg N136 parallel to second-leg M137 and analagous to legs 36 and 37, intervening short-axles 138 akin to 38 and for revolvably supporting beads ("BB", "BBA"), and a secondary-axis 130A between legs N136 and M137 (though axis 130A is colinear with axis 10A rather than obliquely intersecting same). Thus, embodiment "T2" performs analagously to embodiment "T1" as the user manually reciprocates the handle portion. Specifically, the individually rotatable beads along concave shaft 125 are adapted to rollably traverse skin areas "LL" and "Z" in the up-down directions "D" while the beads along short-axles 138 are adapted to rollably traverse the same skin areas but in right-left directions "DD".

Figure 6:
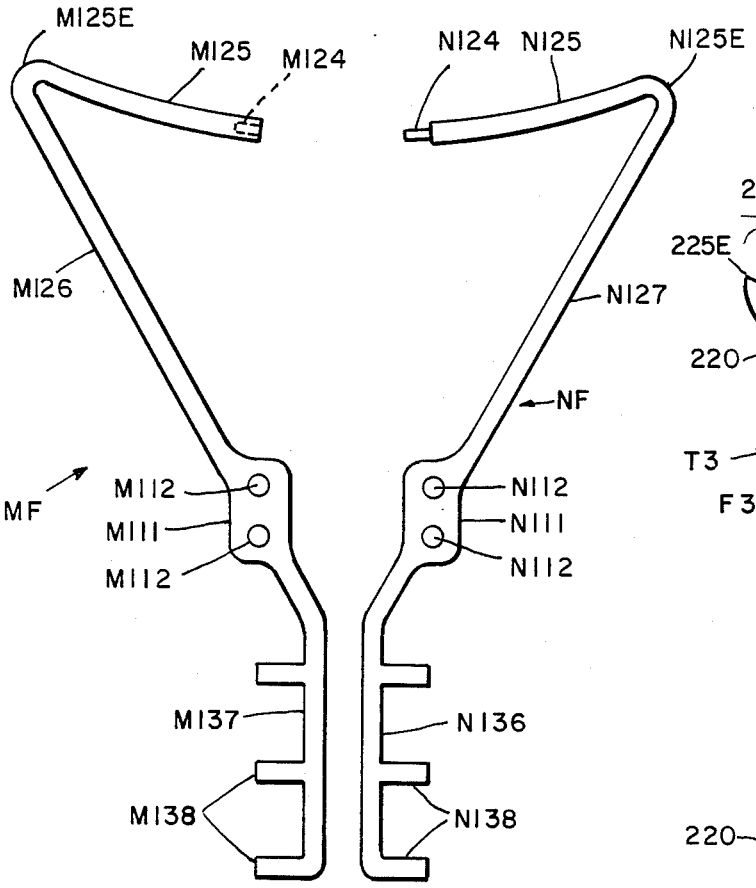
FIG. 6 is an exploded view showing a two subparts subembodiment of the FIG. 5 embodiment "T2"

The FIG. 6 exploded view indicates that frame member "F2" can be conveniently fabricated of two removably connectable unitary subparts ("MF", "NF") which might be molded of sturdy resinous material. First-subpart "MF" provides a first-length M125 and a terminus M125 of concave shaft 125, left-wing M126, a lower-layer M111 of handle portion 110, second-leg M137, and stub portions (at M137) of short-axles 138. Second-subpart "NF" provides a second-length N125 and a terminus N125E of concave shaft 125, right-wing N127, and upper-layer N111 of handle portion 110, first-leg N136, and other stub portions (at N136) of short-axles 138. Removable connections of subparts "MF" and "NF" after the beads are installed is accomplished by: necked extension N124 of subpart "NF" being frictionally engaged within terminal bore M124 of subpart "MF", and lower-layer nibs M112 being frictionally engaged within perforations N112 of upper-layer N111.

Figure 7:
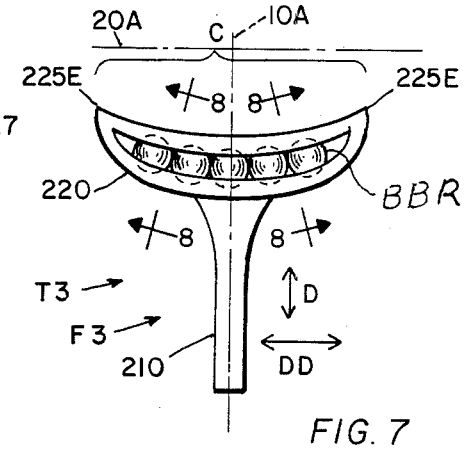
FIG. 7 is a frontal elevational view of an embodiment "T3" of the massaging tool.
Figure 8:
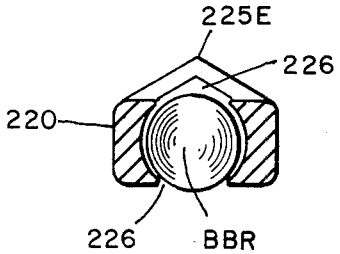
FIG. 8 is a sectional elevational view taken along lines 8—8 of FIG. 7.

In massaging tool embodiment "T3" depicted in FIGS. 7 and 8, spherical rotatable members "BBR" revolvably supported within "ball-bearing" casing 220 as the mounting means therefor, enables a single concave array of rotatable members "BBR" capable of rollably traversing the skin areas "LL" and "Z" in both the up-down directions "D" and in the right-left directions "DD". Analagously as for handles 10 and 110 of embodiments "T1" and "T2", the manually wieldable handle handle 210 for embodiment "T3" extends along longitudinal-axis 10A. Connected to the frontal end of handle 210 and intersecting axis 10A is said single hollow casing 220 which functions as the primary and sole mounting means for frame "F3" and being of generally concave shape with respect to primary-axis 20A. Casing 220 is provided with a concave slot 226 therethrough and having terminii 225E of said spacing "C". Thus, the concave single row array of individually universally rotatable spherical members "BBR" partially protrude through slot 226 so as to contact skin areas "LL" and "Z". Accordingly, as the user manipulates handle 210 in all directions (including "D" and "DD"), skin areas "LL" and "Z" are massagable in a plurality of directions by the same concave array "BBR" and thereby satisfying the method requirements of the present invention.

From the foregoing, the construction and operation of the massaging tool and the practice of the skin massaging method will be readily understood and further explanation is believed to be unnecessary. However, since numerous modifications and changes will readily occur to those skilled in the art, it is not desired to limit the invention to the exact constructions shown and described, and accordingly, further modifications and changes and equivalents may be resorted to, as encompassed by the scope of the appended claims.

I claim:

1. Massaging tool for treating the lower-eyelid and adjacent zygomatic skin areas and during such usage being adapted to reciprocatably rollably traverse along said skin areas in both the general up-down and the general right-left areal directions, said massaging tool comprising:

A. a frame member including a handle extending along a longitudinal-axis and a primary and a secondary mounting means for rotatable members, said frame member comprising two removably connected unitary sub-parts, each sub-part providing substantially one-half of a generally concave shaft primary mounting means extending abruptly to said longitudinal-axis, and each sub-part also providing substantially one-half of a said handle that also includes a said secondary mounting means having a plurality of short-axles respectively consecutively spaced along said longitudinal-axis;

B. a plurality of rotatable members individually revolvably surrounding said concave shaft primary mounting means; and C. a rotatable member revolvably surrounding each of said short-axles of the secondary mounting means.

2. Massaging tool for treating the lower-eyelid and adjacent zygomatic skin areas and during such usage being adapted to reciprocatably rollably traverse along said skin areas in both the general up-down and the general right-left areal directions, said massaging tool comprising:

A. a frame member including:

i. a relatively rearwardly positioned and manually wieldable handle portion extending along a longitudinal-axis, and ii. mounting means adapted to revolvably support a consecutive plurality of individually rotatable spherical members, said mounting means consisting wholly of a single non-linear elongate ball-bearings casing located forwardly of said handle portion and extending generally alongside a primary-axis abruptly intersecting said longitudinal-axis, said ball-bearings casing mounting means having a first-end and a second-end and being generally rearwardly concave between said two ends; and B. a generally rearwardly concave single row of rotatable spherical members respectively revolvably supported by said ball-bearings casing mounting means and in a condition wherein said rotatable spherical members are individually rotatable and partially protrude from said casing, whereby as the user manipulates the handle portion parallel to the longitudinal axis, the said rotatable spherical members reciprocatably rollably traverse in up-down directions along said skin areas, and whereby as the user manipulates the handle portion parallel to the primary-axis, the said rotatable spherical members reciprocatably rollably traverse in the right-left directions along said skin areas.

* * * * *